US007712165B2

(12) United States Patent
Guguin

(10) Patent No.: US 7,712,165 B2
(45) Date of Patent: May 11, 2010

(54) BED WITH A RETRACTABLE SIDE BARRIER

(75) Inventor: Pascal Guguin, Brech (FR)

(73) Assignee: Hill-Rom S.A.S., Pluvigner (FR)

( * ) Notice: Subject to any disclaimer, the term of this patent is extended or adjusted under 35 U.S.C. 154(b) by 1 day.

(21) Appl. No.: 12/170,659

(22) Filed: Jul. 10, 2008

(65) Prior Publication Data

US 2009/0013465 A1 Jan. 15, 2009

(30) Foreign Application Priority Data

Jul. 13, 2007 (FR) ..... 07 56470

(51) Int. Cl.
*A47C 21/08* (2006.01)

(52) U.S. Cl. ..... 5/428; 5/430; 5/425; 5/429

(58) Field of Classification Search ..... 5/428, 5/482, 430, 425, 429; 49/50, 254
See application file for complete search history.

(56) References Cited

U.S. PATENT DOCUMENTS

| | | | |
|---|---|---|---|
| 2,195,955 | A | 4/1940 | Hillenbrand |
| 2,478,028 | A | 8/1949 | Travis |
| 2,587,291 | A | 2/1952 | Des Rochers |
| 2,658,211 | A | 11/1953 | Bendersky |
| 2,676,341 | A | 4/1954 | Leone et al. |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,871,490 | A | 2/1959 | Balonick |
| 3,002,200 | A | 10/1961 | Murcott |
| 3,012,255 | A | 12/1961 | Diehl |
| 3,023,781 | A | 5/1962 | Constanti |
| 3,045,259 | A | 7/1962 | Mayer |
| 3,055,020 | A | 9/1962 | Mann |
| 3,081,463 | A | 3/1963 | Williams et al. |
| 3,220,024 | A | 11/1965 | Nelson |
| 3,419,922 | A | 1/1969 | Malherbe |
| 3,506,989 | A | 4/1970 | Ross et al. |
| 3,526,008 | A | 9/1970 | Pruim |
| 3,585,659 | A | 6/1971 | Burst et al. |
| 3,641,598 | A | 2/1972 | Feldstein |
| 3,840,917 | A | 10/1974 | Taylor |
| 3,851,345 | A | 12/1974 | Benoit et al. |
| 3,855,654 | A | 12/1974 | Pivacek |
| 3,865,434 | A | 2/1975 | Sully |
| 3,930,273 | A | 1/1976 | Stern |

(Continued)

FOREIGN PATENT DOCUMENTS

| | | | |
|---|---|---|---|
| DE | 3510707 | A1 | 10/1986 |

(Continued)

*Primary Examiner*—Peter M Cuomo
*Assistant Examiner*—Brittany M Wilson
(74) *Attorney, Agent, or Firm*—Barnes & Thornburg LLP

(57) ABSTRACT

A bed has a retractable barrier combining vertical movement and transverse movement. The barrier comprises two parallel arms forming portions of a deformable parallelogram system, and each arm is attached the frame by a two-element telescopic mechanism comprising an inner element and an outer element that are constrained relative to each other by a shape connection suitable for varying the transverse position of the barrier element while it is being moved vertically.

7 Claims, 2 Drawing Sheets

U.S. PATENT DOCUMENTS

| | | | |
|---|---|---|---|
| 3,932,903 | A | 1/1976 | Adams et al. |
| 3,971,083 | A | 7/1976 | Peterson |
| 4,103,376 | A | 8/1978 | Benoit et al. |
| 4,183,015 | A | 1/1980 | Drew et al. |
| 4,186,456 | A | 2/1980 | Huempfner |
| 4,612,679 | A | 9/1986 | Mitchell |
| 4,641,385 | A | 2/1987 | Peters et al. |
| 4,653,129 | A | 3/1987 | Kuck et al. |
| 4,747,171 | A | 5/1988 | Einsele et al. |
| 4,949,410 | A | 8/1990 | Failor et al. |
| 4,985,946 | A | 1/1991 | Foster et al. |
| 4,987,623 | A | 1/1991 | Stryker et al. |
| 4,993,089 | A | 2/1991 | Solomon et al. |
| 5,083,334 | A | 1/1992 | Huck et al. |
| 5,129,117 | A | 7/1992 | Celestina et al. |
| 5,187,824 | A | 2/1993 | Stryker |
| 5,394,580 | A | 3/1995 | Foster et al. |
| 5,604,942 | A | 2/1997 | Allevato et al. |
| 5,732,423 | A | 3/1998 | Weismiller et al. |
| 5,784,732 | A | 7/1998 | Vail |
| 5,802,636 | A | 9/1998 | Corbin et al. |
| 5,878,452 | A | 3/1999 | Brooke et al. |
| 6,021,533 | A | 2/2000 | Ellis et al. |
| 6,167,580 | B1 | 1/2001 | Draheim et al. |
| 6,182,310 | B1 | 2/2001 | Weismiller et al. |
| 6,253,397 | B1 | 7/2001 | Bartow et al. |
| 6,360,385 | B1 | 3/2002 | Lewandowski |
| 6,397,416 | B2 | 6/2002 | Brooke et al. |
| 6,446,283 | B1 | 9/2002 | Heimbrock et al. |
| 6,622,323 | B2 | 9/2003 | Zerhusen et al. |
| 6,640,361 | B2 | 11/2003 | Heimbrock et al. |
| 6,658,680 | B2 | 12/2003 | Osborne et al. |
| 6,691,345 | B2 | 2/2004 | Nanahara |
| 6,751,815 | B2 | 6/2004 | Heimbrock et al. |
| 6,779,209 | B2 | 8/2004 | Ganance |
| 6,829,793 | B2 | 12/2004 | Brooke et al. |
| 6,851,142 | B2 | 2/2005 | Stryker et al. |
| 6,874,179 | B2 | 4/2005 | Hensley et al. |
| 6,938,289 | B2 | 9/2005 | Morin |
| 6,951,036 | B2 | 10/2005 | Lemire |
| 7,028,352 | B2 | 4/2006 | Kramer et al. |
| 7,073,220 | B2 | 7/2006 | Simmonds et al. |
| 7,082,630 | B2 | 8/2006 | Castonguay et al. |
| 7,107,637 | B2 | 9/2006 | Kuek et al. |
| 7,412,734 | B2 | 8/2008 | Stryker et al. |
| 2002/0144348 | A1 | 10/2002 | Ganance |
| 2006/0090259 | A1* | 5/2006 | Castonguay et al. ..... 5/430 |
| 2006/0277683 | A1* | 12/2006 | Lamire et al. ..... 5/425 |
| 2009/0007334 | A1 | 1/2009 | Stryker et al. |
| 2009/0139028 | A1* | 6/2009 | Morin et al. ..... 5/430 |

FOREIGN PATENT DOCUMENTS

| | | | |
|---|---|---|---|
| EP | 0 680 714 | A1 | 11/1995 |
| EP | 1 053 735 | A2 | 11/2000 |
| EP | 1 108 410 | A2 | 6/2001 |
| EP | 1 243 207 | A1 | 9/2002 |
| JP | 09206177 | A | 8/1997 |
| JP | 09276340 | A | 10/1997 |
| WO | WO 98/17153 | | 4/1998 |
| WO | WO 02/32271 | A1 | 4/2002 |
| WO | WO 03/070061 | A1 | 8/2003 |
| WO | WO 2007/019692 | A1 | 2/2007 |

* cited by examiner

BED WITH A RETRACTABLE SIDE BARRIER

The present application claims priority, under 35 U.S.C. §119(a), of French National Application No. 07 56470 which was filed Jul. 13, 2007 and which is hereby incorporated by reference herein.

BACKGROUND

The present disclosure relates to a bed with a retractable side barrier, and more particularly to a bed comprising a side barrier element that is movable between a high position and a low position in which it is retracted under the edge of the bed. The present disclosure relates more particularly to a mechanism that moves the barrier between its high position and its retracted, low position.

A patient bed is known that includes at least one retractable side barrier. The bed comprises a bottom bedstead or frame supporting a bedding plane, together with a side barrier element extending along the side of the frame. The barrier element, the frame of the bed (more particularly a longitudinal member thereof), and two parallel arms (respectively attached to the frame and to said barrier elements via hinges) form a deformable parallelogram mechanism enabling the barrier element to be moved between two stable positions, a high position above the mattress of the bed, to prevent a patient from falling out of bed, and a low position close to the frame of the bed. The barrier is lowered when it is desired to transfer the patient to give the patient care.

Several factors need to be taken into consideration when developing such a bed.

For the purpose of moving the bed (which is mounted on casters) it is desirable for the overall transverse size of the bed to be as small as reasonably possible so that it can pass through relatively narrow doors or so that it can be situated in small elevators.

Conversely, patient comfort may require a mattress to be as wide as possible.

Furthermore, when transferring a patient between a stretcher and the bed, it is desirable for the distance between the edge of the stretcher and the edge of the mattress to be as small as possible, the barrier then naturally being in its lowered position.

For all these reasons, proposals have been made for the barrier to be retractable under the mattress, beside the frame, when the barrier is in its lowered position. Mechanisms have therefore been devised for lowering the barrier, and then retracting it under the bed while it is in its low position. To follow such a path the barrier moves vertically downwards and while turning in its own plane, followed by moving transversely so as to become situated under the mattress and prevent the barrier constituting a troublesome obstacle while moving the bed or while moving a stretcher up to the bed.

SUMMARY

The mechanisms disclosed herein make it possible to improve the motion of such a barrier by combining rotation and transverse displacement so as to enable the barrier to be retracted in a single movement.

More particularly, the mechanism disclosed herein provides a bed with a retractable side barrier, the bed comprising a bed frame, a side barrier element extending along one side of said frame, and two parallel arms attached respectively via hinges to said frame and to said barrier element, wherein each arm is attached to said bed frame by a two-element telescopic mechanism comprising an inner element and an outer element, one of the elements being fastened to the frame and the other to said arm, and wherein these two elements are constrained relative to each other by a shape connection suitable for causing the transverse position of said barrier element to vary continuously while it is being moved in vertical pivoting.

When the barrier element is in its low position, the telescopic mechanism is fully retracted so that both arms of the side barrier element are retracted.

In some embodiments, for each telescopic mechanism, the element that is secured to the frame of the bed contains the element that is fastened to the arm. It may be welded to the frame.

According to one possibility, the shape connection comprises a stud carried by one element and a groove formed in the other element.

The studs of the two telescopic mechanisms enable the two movements, one in rotation and the other in transverse translation, to be combined, and they also enable the barrier to be attached to the element that is secured to the frame of the bed.

In one possible variant, for each telescopic mechanism, the stud is secured to the inner element and projects outwards, being engaged in the groove formed in the outer element.

The inverse arrangement is also possible, i.e. the stud may be secured to the outer element and project inwards, being engaged in the groove formed in the inner element.

The shape of the groove is adapted to the desired motion.

BRIEF DESCRIPTION OF THE DRAWINGS

The mechanisms disclosed herein can be better understood and other features thereof appear better in the light of the following description of a bed in accordance with this disclosure, given purely by way of example and made with reference to the accompanying drawings, in which.

DETAILED DESCRIPTION

Figure 1:
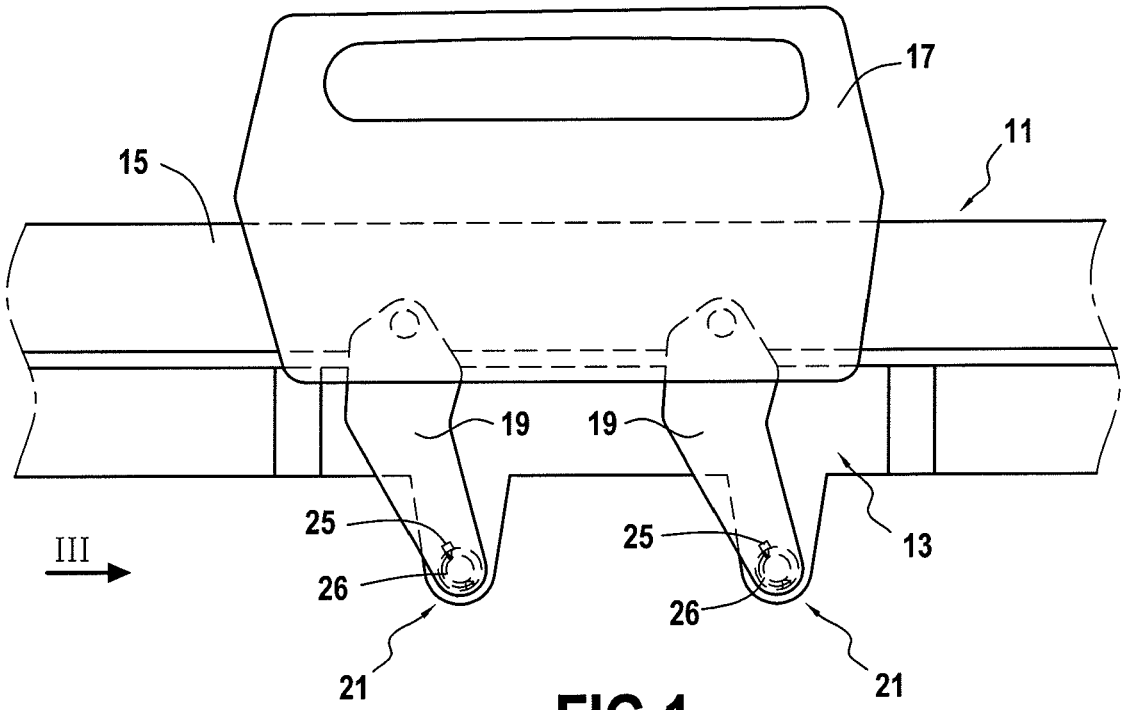
FIG. 1 is a fragmentary diagrammatic view of a bed with a retractable side barrier in accordance with this disclosure, the barrier being raised.
Figure 2:
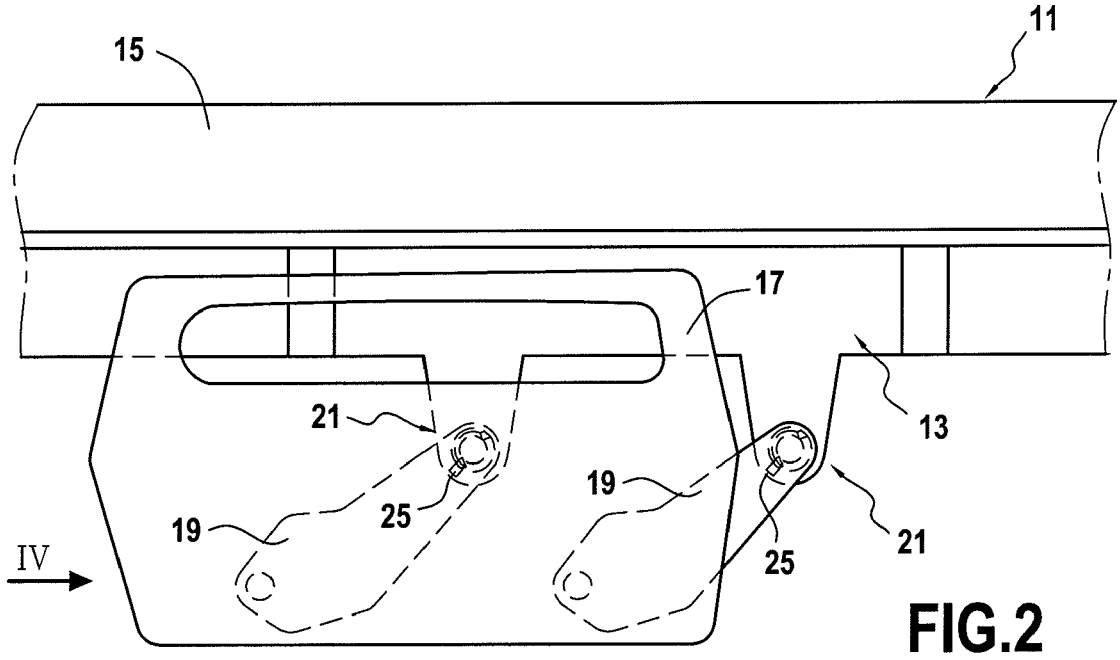
FIG. 2 is a view similar to FIG. 1, the barrier being lowered.
Figure 3:
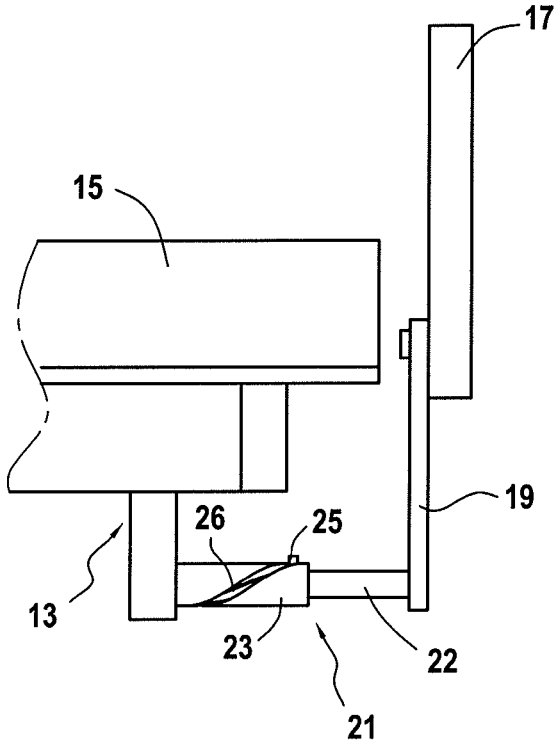
FIG. 3 is a detail view seen looking along arrow III of FIG. 1.
Figure 4:
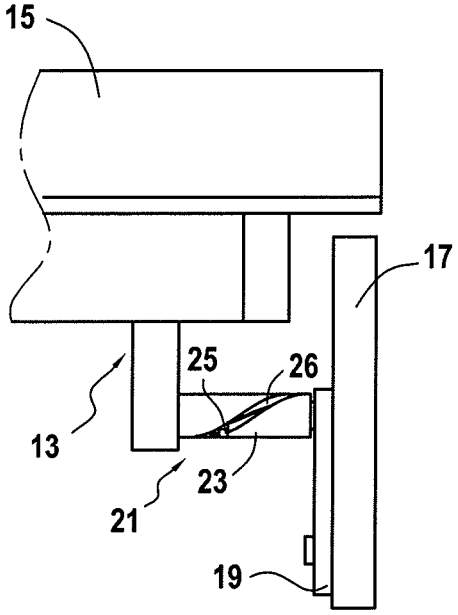
FIG. 4 is a detail view seen looking along arrow IV of FIG. 2.

In the drawings, there can be seen a patient bed 11, having a retractable side barrier comprising a bottom frame 13 supporting the bedding (mattress 15), a side barrier element 17 extending along a longitudinal side of the frame, and two parallel arms 19 respectively attached by hinges to the frame and to the barrier element. Together, the above-mentioned elements form a kind of deformable parallelogram enabling the barrier element to be moved substantially parallel to itself, essentially by pivoting the arms.

In accordance with this embodiment, each arm 19 is connected to the frame of the bed via a two-element telescopic mechanism 21 having an inner element 22 and an outer element 23. The inner element 22 can move by sliding and in rotation inside the outer element 23. In this example, the outer element is fastened to the frame, e.g. welded thereto. It is oriented perpendicularly to the longitudinal direction of the bed. The other element, i.e. the inner element 22, is fastened to one end of the corresponding arm 19.

These two elements 22, 23 are constrained relative to one another by a coupling arrangement comprising a stud 25 and a groove 26. In the illustrative example, the groove 26 is helical and extends only partially around element 23 which is tubular. In some embodiments, the groove 26 is sufficiently long to permit the pin 25 to rotate through about 180 degrees while moving inwardly and outwardly when barrier element 17 is raised and lowered. Barrier element 17 may be a siderail of a hospital bed, for example. Fashioning groove 26 such that the angles of rotation of pin 25 is either more or less than 180 degrees is contemplated by this disclosure, as well.

More precisely, in the example shown in FIGS. 1 to 4, the stud 25 is secured to the inner element and projects outwards, being engaged in the groove 26 formed in the wall of the outer element. Each telescopic mechanism thus provides the connection between the frame 13 and one of the arms 19. They are substantially identical, thus making it possible to vary the transverse position of the barrier element 17 (hinged on the other ends of the two arms) while simultaneously moving it in vertical pivoting.

Figure 5:
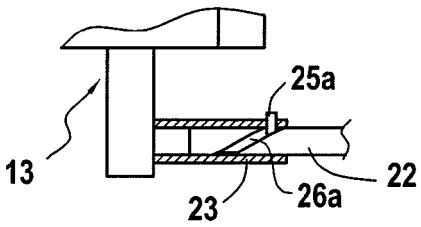
FIG. 5 is a detail view showing a variant.

FIG. 5 shows a variant in which the stud 25*a* is secured to the outer element 23 and projects inwards, being engaged in a groove 26*a* formed in the inner element. This groove may be a simple groove formed in the surface of the cylindrical inner element 22. The groove 26*a*, in some embodiments, is helical and extends around element 22, which may be a solid post or a tubular post in some embodiments. In some embodiments, the groove 26*a* is sufficiently long to permit the element 22 to rotate through about 180 degrees while moving inwardly and outwardly when barrier element 17 (not shown in FIG. 5) is raised and lowered. Fashioning groove 26*a* such that the angle of rotation of element 22 is either more or less than 180 degrees is contemplated by this disclosure, as well.

Figure 6:
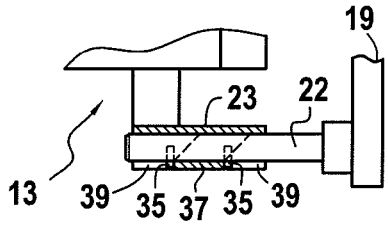
FIG. 6 is a detail view showing another variant.

Another variant is shown in FIG. 6 in which the inner element 22 carries two studs 35 projecting outwards and co-operating with parallel edges of a cam 37 defined in the wall of the outer element. The two studs 35 and the cam 37 define the connection having the above-mentioned shape. The cam is formed in the wall of the outer element by two cutouts or notches 39, with the two end portions of the sleeve constituting said outer element 23. The sleeve is secured to the bottom frame 13. This variant makes it possible to obtain said outer and 23 directly by molding, without any subsequent machining. The edges of cam 37 (shown in phantom in FIG. 6) may be helical in some embodiments. The cam 37 may be fashioned, in some embodiments, to permit pins 35 to rotate through about 180 degrees while moving inwardly and outwardly when barrier element 17 (not shown in FIG. 6) is raised and lowered. Fashioning groove 26*a* such that the angle of rotation of pins 35 is either more or less than 180 degrees is contemplated by this disclosure, as well.

The invention claimed is:

1. A bed with a retractable side barrier, the bed comprising a bed frame, a side barrier element extending along one side of said frame, and two parallel arms pivotably coupled to said frame and to said barrier element, wherein each arm is attached to said bed frame by a telescopic mechanism comprising an inner element and an outer element, one of the elements being fastened to the frame and the other to said arm, and wherein these two elements are constrained relative to each other by a shape connection that is configured to force the transverse position of said barrier element relative to the bed frame to vary continuously while the barrier element is being raised and lowered, wherein the shape connection comprises one of a helical groove and a helical cam that is provided on one of the inner and outer elements and that extends between a top of one of the inner and outer elements that has the helical groove or cam and a bottom of one of the inner and outer elements that has the helical groove or cam so that relative rotation between the inner and outer elements through about 180 degrees is permitted.

2. A bed according to claim 1, wherein said shape connection comprises a stud carried by one of the inner and outer elements.

3. A bed according to claim 2, wherein for each telescopic mechanism, said stud is secured to the inner element and projects outwards.

4. A bed according to claim 2, wherein for each telescopic mechanism, said stud is secured to the outer element and projects inwards.

5. A bed according to claim 1, wherein said shape connection comprises two studs carried by the inner element.

6. A bed according to claim 5, wherein, if the shape connection comprises the helical cam, said cam is formed in the wall of the outer element by two cutouts or notches formed in the two end portions thereof.

7. A bed according to claim 1, wherein, for each telescopic mechanism, the element that is fastened to the frame contains the element that is fastened to said arm.

* * * * *